US005626187A

United States Patent [19]

Nilsson

[11] Patent Number: 5,626,187

[45] Date of Patent: May 6, 1997

[54] HEAT-EXCHANGER TUBE

[76] Inventor: Håkan Nilsson, Fölvägen 12, S-175 39 Järfälla, Sweden

[21] Appl. No.: 355,072

[22] Filed: Dec. 13, 1994

[30] Foreign Application Priority Data

Dec. 14, 1993 [EP] European Pat. Off. ..... 93850231

[51] Int. Cl.[6] ..... F28F 19/00; F28F 21/02

[52] U.S. Cl. ..... 165/134.1; 165/180; 165/181

[58] Field of Search ..... 165/179, 180, 165/181, 185, 134.1

[56] References Cited

U.S. PATENT DOCUMENTS

| | | | |
|---|---|---|---|
| 2,093,686 | 9/1937 | Murray, Jr. | 165/181 X |
| 2,566,318 | 9/1951 | Dalin et al. | 165/181 X |
| 2,719,354 | 10/1955 | Dalin | 165/185 X |
| 3,731,738 | 5/1973 | Cooper | 165/180 |
| 3,890,143 | 6/1975 | Skoglund et al. | 75/125 |
| 5,107,798 | 4/1992 | Gerep | 165/181 X |

FOREIGN PATENT DOCUMENTS

| | | |
|---|---|---|
| 2180117 | 4/1973 | France . |
| 60194 | 4/1982 | Japan . |
| 9002916 | 3/1990 | WIPO . |
| 9002927 | 3/1990 | WIPO . |

*Primary Examiner*—Leonard R. Leo

[57] ABSTRACT

A heat-exchanger tube (16) comprises a tubular body (17) and surface enlarging elements provided on said body (17) and consisting of a large number of pins (18) which are welded to the tube body (17) at the outer side thereof and which extend in outward directions from the tube body (17). The tube body (17) and the pins (18) are made of carbon steel. However, in order to reduce the risk of crack formations in the weld joints between the pins (18) and the tube body (17) or in portions of the pins (18) located adjacent to the tube body (17), the pins (18) are made of a material having a substantially lower carbon content than the material of which the tube body (17) is made.

3 Claims, 2 Drawing Sheets

HEAT-EXCHANGER TUBE

The present invention relates to a heat-exchanger tube of the kind comprising a tubular body and surface enlarging elements provided on the tube body and consisting of a large number of pins which are welded to the tube body at the outer side thereof and which extend in outward directions from the tube body, said tube body as well as said pins being made of carbon steel.

Heat-exchanger tubes of the above kind, which are also referred to as pin tubes, exist in many different shapes and are utilized for a plurality of different purposes. For instance, one technical field, within which such heat-exchanger tubes have been used to a substantial extent, is cylindrical boilers. In such boilers, heat-exchanger tubes of the above kind have been used since long ago to recover heat from the flue gases during their passage through flue gas tubes, or uptakes, which extend in vertical upward directions through the pressure vessel located above the furnace of the boiler and forming a steam and water space. The heat-exchanger tubes are mounted in coaxial positions within the flue gas tubes and are connected to the pressure vessel in order to transfer heat to the fluid contained therein.

Prior art heat-exchanger tubes of the above kind have been found to suffer from a tendency to crack formations in the weld joints between the pins and the tube body or in adjacent portions of the pins. Normally, said tendency will be especially pronounced if the pins, after having been welded to the tube body, are bent through a cold forming operation. However, it may occur also in connection with other pins. In practice, the above crack formation tendency may cause very difficult problems. Thus, although originally being of a very small size, small initial cracks caused during the manufacture of the heat-exchanger tubes may successively grow into larger cracks which, in the end, may weaken the pins to such a degree that these may be broken away from the tube body if subjected to substantial mechanical forces, for instance in connection with the removal of soot from the flue gas tubes in which the heat-exchanger tubes are mounted.

The invention has for its purpose to provide an improved heat-exchanger tube of the kind initially specified which strongly reduces the risk of any crack formation of the type above described.

In accordance with the invention, for this purpose, there is provided a heat-exchanger tube of said kind, primarily characterized in that the pins are made of a material having a substantially lower carbon content than the material of which the tube body is made.

The invention is based on the understanding that the crack formation tendency noticed at known heat-exchanger tubes of the kind here at issue has been caused by the fact that the heating and subsequent cooling of the portions of the pins located closest to the tube body, inevitably taking place during the welding operation, result in that the material in said portions of the pins are subjected to an unintentional hardening causing an increased brittleness. Furthermore, the invention is also based on the understanding that said unintentional hardening is a consequence of the fact that the pins have previously been made of a carbon steel of ordinary commercial grade having at least approximately the same carbon content as the material of which the tube body is made.

While the tube body is usually made of a carbon steel having a carbon content of at least about 0.1%, according to the invention, the pins may preferably be made of a material having a carbon content not exceeding about 0.05%.

Especially in the case of heat-exchanger tubes where the pins are bent through a cold formation operation carried out after the step of welding the pins to the tube body, the pins may preferably be made of a material having a carbon content of only about 0.03%.

The proposed use in the pins of a steel having a very low carbon content has been found to result in a further favourable effect in addition to the abovementioned reduction in the risk of crack formations. More particularly, the reduced carbon content results in an increase in the thermal conductivity of the pins which, in its turn, causes an improvement in the thermal efficiency of the pins and hence an increase in the total coefficient of thermal transmittance of the heat-exchanger tube as a whole. A calculation of the coefficient of thermal transmittance of a heat-exchanger tube according to a practical embodiment utilized in cylindrical boilers has shown that it is possible to increase said coefficient by about 4% by shifting from utilizing pins of carbon steel of ordinary commercial grade having a carbon content of 0.11% to pins of a special steel having a carbon content of only 0.03%.

Below the invention will be further described with reference to the accompanying drawing, in which.

Figure 1:
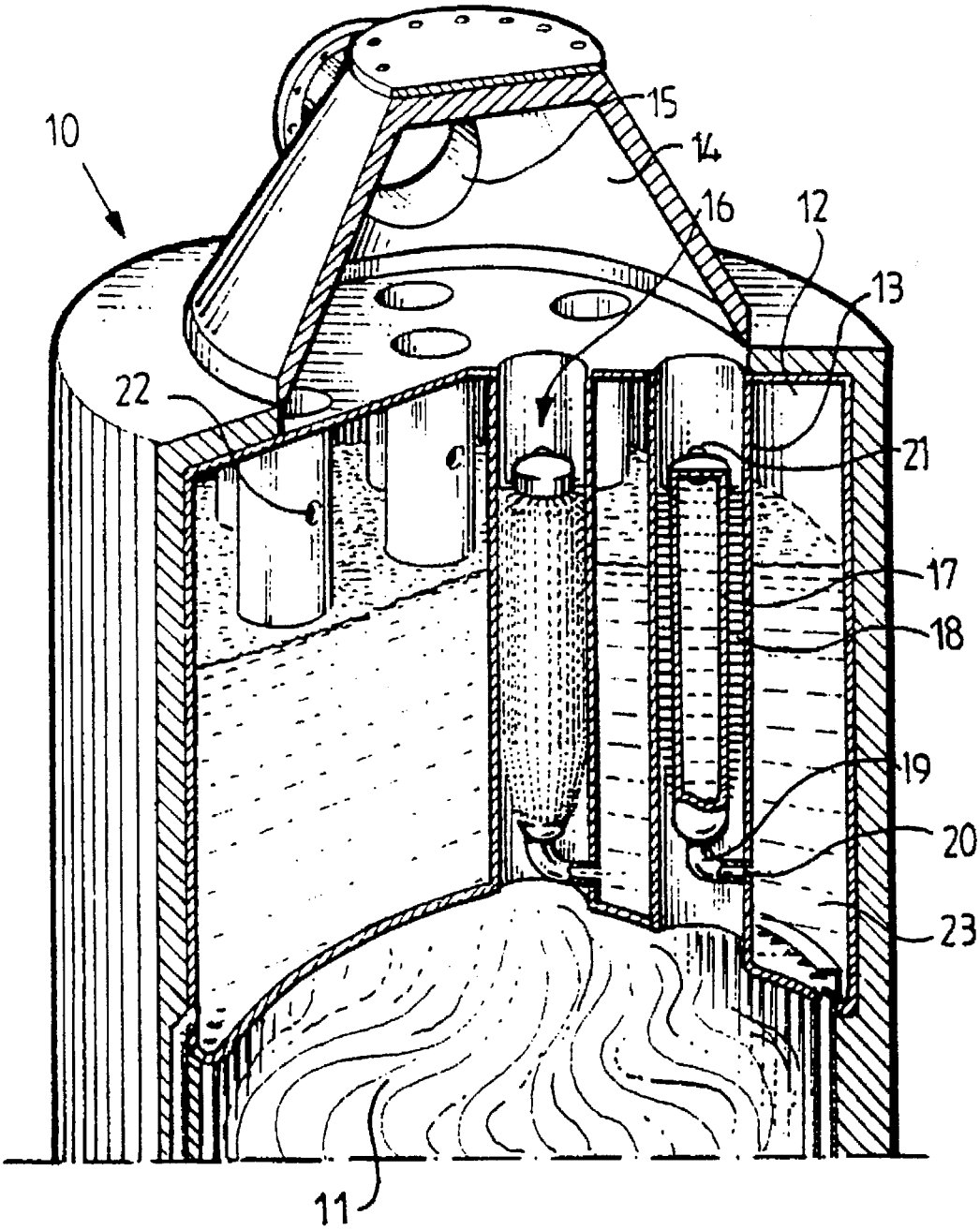
FIG. 1 shows a partial view, in section, of a cylindrical boiler provided with a plurality of heat-exchanger tubes of the kind to which the invention relates.

The cylindrical boiler shown only partially in FIG. 1 and generally designated 10 comprises a furnace 11 and a pressure vessel 12 located above said furnace and forming the steam and water space of the boiler. A plurality of vertical flue gas tubes or uptakes 13 extend through pressure vessel 12 to conduct the flue gases from furnace 11 to a flue gas receiver 14 which is located on top of pressure vessel 12 and from which the flue gases may be discharged through a flue gas outlet 15.

Inside each flue gas tube 13, there is provided a heat-exchanger tube, generally designated 16, which comprises a tubular body 17 and surface enlarging elements mounted on said tube body. As may best be seen from FIGS. 2 to 4, said surface enlarging elements consist of a large number of pins 18 which are welded to tube body 17 at the outer side thereof and which extend in outward directions from the tube body. At its lower end, each heat-exchanger tube 17 is provided with an inlet conduit 19 through which it communicates with the steam and water space formed by pressure vessel 12 via an opening 20 in the wall of the surrounding flue gas tube 13, while at its upper end, it is provided with an outlet conduit 21, through which it communicates with pressure vessel 12 via an opening 22 in the wall of flue gas tube 13.

The more detailed structure and function of the boiler above briefly described may be of a kind known per see and will therefore not be described in greater detail here. Thus, it appears sufficient to mention that suitable means, not shown, may be provided to cause a continuous circulation of water through ducts 23, surrounding furnace 11, in order hereby to transfer heat from the furnace to the water contained in pressure vessel 12 via the walls of the furnace. Additional heat is transferred to said water from the flue gases flowing through flue gas tubes 13, both due to a conduction of heat through the walls of the flue gas tubes and by means of heat-exchanger tubes 16, through which a continuous circulation of water will take place. In pressure vessel 12, the above-mentioned heat transfer will cause a generation of steam which may be discharged from the pressure vessel by suitable means, not shown.

Figure 2:
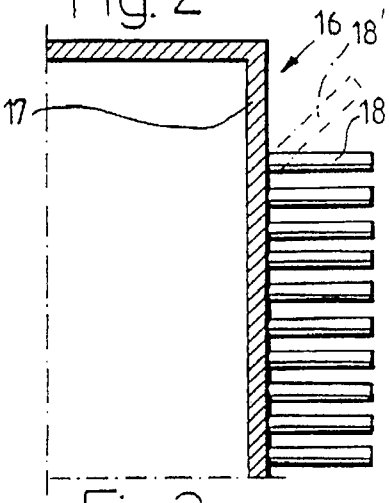
FIG. 2 shows a partial view, on an enlarged scale and in longitudinal section, of an upper portion of one of said heat-exchanger tubes.
Figure 3:
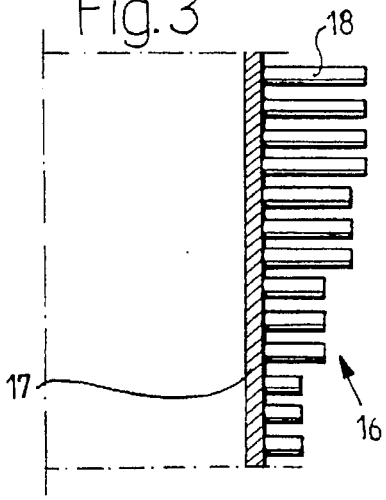
FIG. 3 shows a partial view, in longitudinal section, of a lower portion of one of said heat-exchanger tubes.
Figure 4:
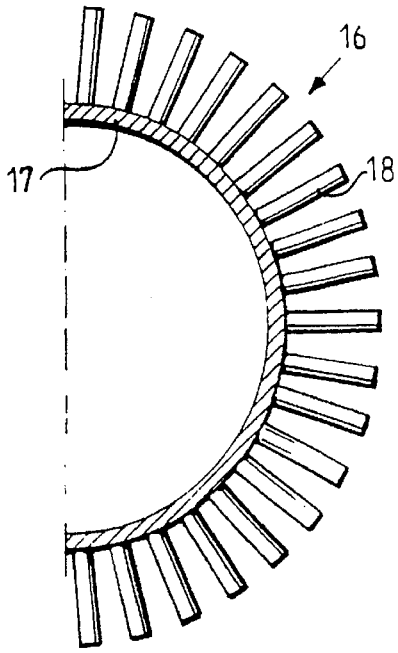
FIG. 4 shows a cross-sectional view of one of said heat-exchanger tubes.

As shown in FIGS. 2, 3 and 4, heat-exchanger tubes 16 may be provided with pins 18 which extend in truly radial directions from tube body 17 and which, at least along a major portion of the tube body, are of mutually equal length. However, along a lower portion of tube body 17, the length of pins 18 may preferably decrease in a direction towards the lower end of the tube body in a manner illustrated in FIG. 3 in order hereby to ensure that the pins will not be heated to unacceptably high temperatures. If so desired, it is also possible to provide an upper portion of tube body 17 with pins having an increased length, in which case said pins are bent after having been welded to the tube body. One such bent pin 18' of increased length has been indicated in dash-dotted lines in FIG. 2.

Tube body 17 as well as pins 18 are made of carbon steeel. In known manner, tube body 17 is made of a material suited to yield the tube body its desired strength and having a carbon content of preferably at least about 0.1%. In the prior art, pins 18 have also been made of a carbon steel of ordinary commercial quality having av carbon content of at least about 0.1%, i.e. a material having approximately the same carbon content as the material of which the tube body is made. However, according to the invention, pins 18 should be made of a material having a substantially lower carbon content than the material of which tube body 17 is made. Hereby, it is possible to obtain a considerable reduction of the prior risk of crack formations in the weld joints between pins 18 and tube body 17 or in adjacent portions of said pins. Additionally, the thermal efficiency of pins 18 is improved and hence, the total coefficient of thermal transmittance of each heat-exchanger tube 16 as a whole is increased.

The material of which pins 18 are made should preferably have a carbon content not exceeding about 0.05%. If, as indicated in respect of pin 18' in FIG. 2, the pins are bent in a cold state after having been welded to the tube body, they should however preferably be made of a material having a carbon content of only about 0.03%.

Figure 5:
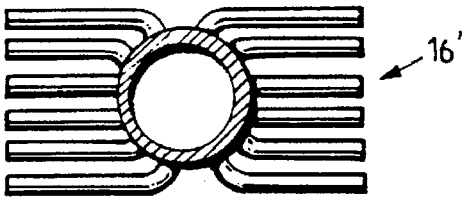
FIGS. 5 to 7 show cross-sectional views of heat-exchanger tubes according to various modified embodiments, intended for special purposes.
Figure 6:
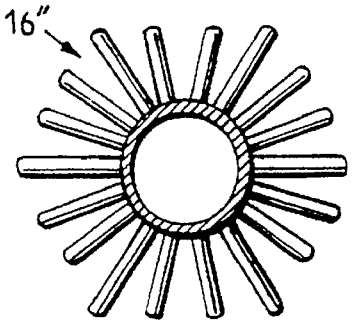
Figure 7:
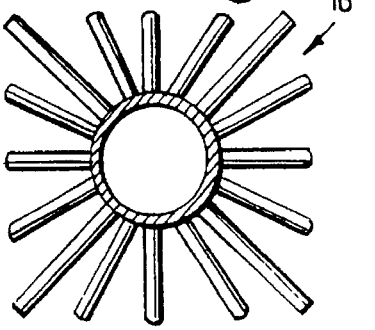

The invention is not restricted to the embodiment of the heat-exchanger tubes above described and shown in FIGS. 1 to 4. Instead, it may be applied also on heat-exchanger tubes of many other embodiments. By way of example, FIGS. 5, 6 and 7 illustrate heat-exchanger tubes 16', 16" and 16'", respectively, which are intended for other applications and on which the invention may be applied.

I claim:

1. A heat-exchanger tube for use in boilers, comprising:

a tubular body having an outer surface and surface enlarging elements provided on the outer surface of the tubular body communicating with hot flue gases within the boiler, and the surface enlarging elements being a plurality of pins affixed to the tubular body at the outer surface thereof and extending in outward directions from the tubular body, said tubular body and the pins being of carbon steel, with the pins having a substantially lower carbon content than the tubular body, wherein the pins are of carbon steel having a carbon content of about 0.03% by weight thereby to reduce the risk of crack formation in joints between the tubular body and the pins.

2. A heat-exchanger tube according to claim 1, wherein the pins are welded to the tubular body.

3. A heat-exchanger tube for use in boilers, comprising:

a tubular body having an outer surface, and surface enlarging elements provided on the outer surface of the tubular body communicating with hot flue gases within the boiler, and the surface enlarging elements being a plurality of pins affixed to the tubular body at the outer surface thereof and extending in outward directions from the tubular body, the tubular body and the pins being of carbon steel, with the pins having a substantially lower carbon content than the tubular body, and the pins are of carbon steel having a carbon content not exceeding 0.05% by weight thereby to reduce the risk of crack formation in joints between the tubular body and the pins.

* * * * *